US005290099A

United States Patent [19]

Lechman

[11] Patent Number: 5,290,099

[45] Date of Patent: Mar. 1, 1994

[54] ADJUSTABLE MONITOR SUPPORT

[75] Inventor: John N. Lechman, Effingham, Ill.

[73] Assignee: Nova Manufacturing & Assembly, Inc., Effingham, Ill.

[21] Appl. No.: 24,196

[22] Filed: Feb. 26, 1993

Related U.S. Application Data

[63] Continuation-in-part of Ser. No. 907,193, Jun. 30, 1992, abandoned, which is a continuation-in-part of Ser. No. 693,392, Apr. 30, 1991, Pat. No. 5,125,727, which is a continuation-in-part of Ser. No. 595,864, Oct. 11, 1990, abandoned.

[51] Int. Cl.[5] ..... A47B 21/00

[52] U.S. Cl. ..... 312/208.1; 312/223.3; 108/107

[58] Field of Search ..... 312/196, 194, 7.2, 208.1, 312/223.3; 108/107, 109

[56] References Cited

U.S. PATENT DOCUMENTS

| | | | |
|---|---|---|---|
| 4,590,866 | 5/1986 | Scharbaum | 312/7.2 |
| 4,755,009 | 7/1988 | Price et al. | 312/194 |
| 5,071,204 | 12/1991 | Price et al. | 312/194 |
| 5,087,010 | 2/1992 | Walters | 248/455 |
| 5,125,727 | 6/1992 | Lechman | 312/194 |

FOREIGN PATENT DOCUMENTS

| | | | |
|---|---|---|---|
| 1106895 | 8/1981 | Canada . | |
| 0560631 | 4/1975 | Switzerland | 108/107 |

*Primary Examiner*—Kenneth J. Dorner
*Assistant Examiner*—Gerald A. Anderson
*Attorney, Agent, or Firm*—Olson & Hierl, Ltd.

[57] ABSTRACT

A self-upholding, free-standing adjustable monitor support structure that is adopted for association with, and for support of, a top platform member that includes a transparent portion. The monitor support structure includes a shelf member, a pair of side supports which are each equipped with a pair of legs and a plurality of transversely extending, vertically spaced load bearing members, and adjustable connector means for connecting the shelf member with each side support. Optionally but preferably, the side supports also each include a transverse bar which is configured to support a drawer slide in combination with an associated leg member; thus, the monitor support structure can also support a horizontally slidable keyboard tray. The combination of the monitor support structure and the top platform member provides a useful work station.

12 Claims, 2 Drawing Sheets

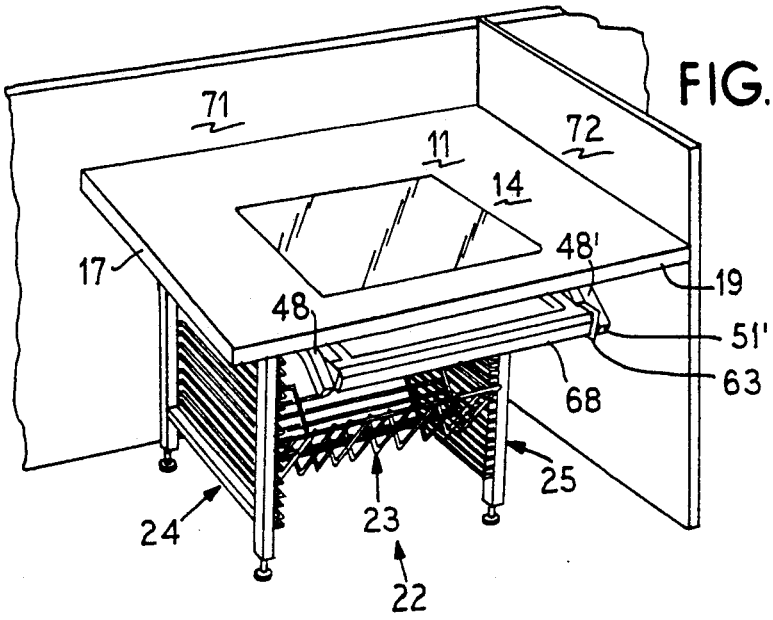
FIG. 1
FIG. 2
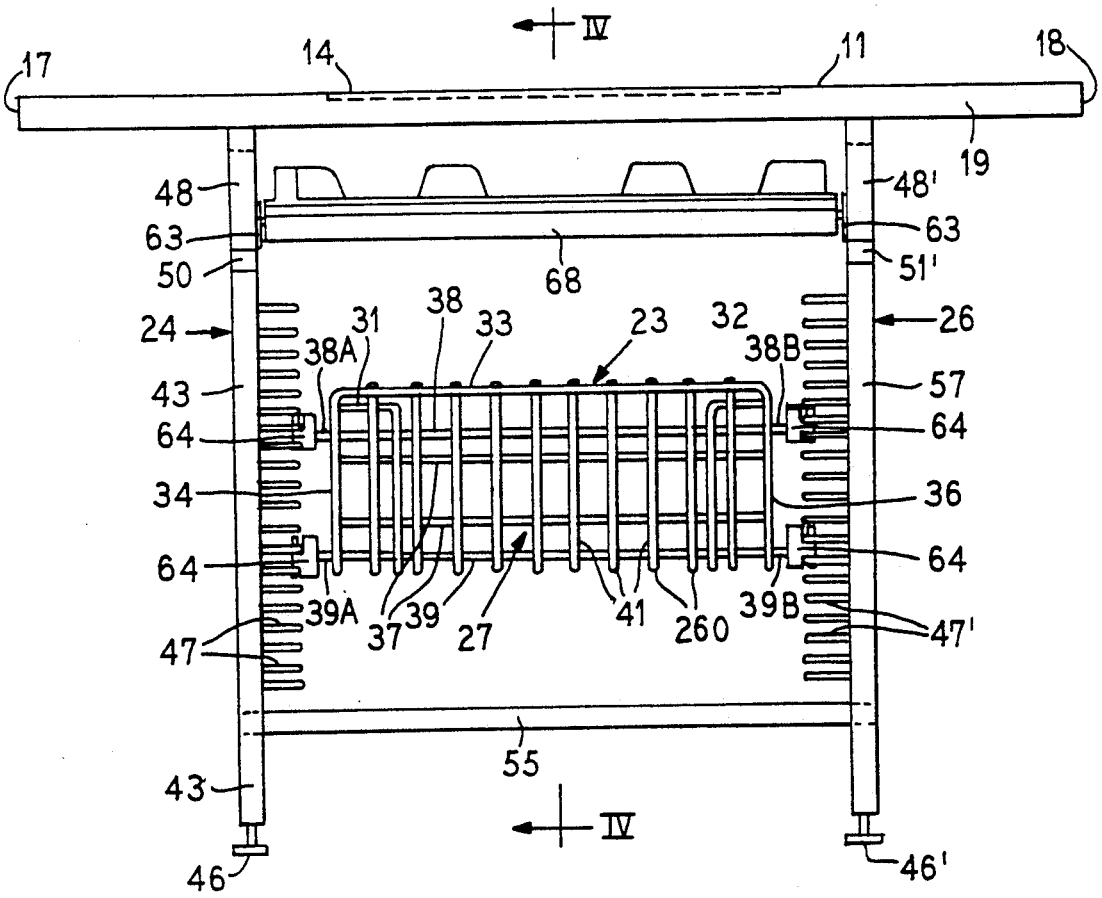

ADJUSTABLE MONITOR SUPPORT

RELATED APPLICATION

This application is a continuation-in-part of U.S. patent application Ser. No. 907,193 filed Jun. 30, 1992 now abandoned, which is a continuation-in-part of U.S. Ser. No. 693,392 filed Apr. 30, 1991 now U.S. Pat. No. 5,125,727 issued Jun. 30, 1992, which is a continuation-in-part of U.S. patent application Ser. No. 595,864 filed Oct. 11, 1990, now abandoned.

FIELD OF THE INVENTION

This invention relates to an adjustable monitor support assembly for use in a modular environment or the like in association with a top platform member which includes a transparent portion through which a supported monitor can be viewed.

BACKGROUND OF THE INVENTION

A new and very useful type of adjustable underdesk monitor support assembly for a desk structure, computer work station structure or the like is provided in Lechman et al. U.S. Pat. No. 5,125,727 which permits a monitor so supported to be viewable through a transparent portion in the structure working platform. This type of monitor support assembly is well suited not only for use in free standing desks, computer work stations, and the like, but also for use in work stations that are incorporated into a modular environment (see, for example, Lechman et al. U.S. Ser. No. 778,333 filed Oct. 17, 1991).

In a modular environment, wall and even floor surfaces of cubicle defining members are associatable where practical with functional furniture components. A common objective in a modular structure is to provide a maximized usable working area (volumetrically and also surface-area wise).

The modular desk structure provided in the aforementioned U.S. Ser. No. 778,333 requires that the associated monitor support structure by cooperatively engaged with side, back and bottom members that are a part of a desk structure. For reasons of cost efficiency and improved space utilization, it has been found that an improved adjustable monitor support structure is needed which avoids the need for associated desk members along side, back and bottom portions. The present invention provides such a monitor support structure.

SUMMARY OF THE INVENTION

The present invention provides a self-upholding, free-standing adjustable monitor support structure. This structure is adapted for association with, and for support of, a top platform member that includes a transparent portion. Such an association provides a novel and very useful work station.

Either the monitor support structure, or the top platform member, or both, is/are additionally associated with a back upright panel member, such as a conventional modular wall panel, a desk modesty panel or the like, thereby to stabilize the monitor support structure and the associated platform member against tipping or the like.

A monitor held by the monitor support structure can be viewed through the transparent portion of the platform member; for example, by a worker seated adjacent to the front edge of the platform member. The platform member can have various configurations.

The inventive monitor support structure is simple, reliable and sturdy, and it requires no associated side, back, or bottom desk components. Advantageously, this monitor support structure can be used not only in a modular environment, but also in free-standing desk and work station structures, including retrofit applications, if desired.

The monitor support assembly has a monitor supporting shelf member that is adjustably supported at each lateral side thereof by a different one of a pair of side supports. Each side support has incorporated legs and the side supports are cooperatively engaged to each other by a C-configured, horizontally oriented cross support that is in spaced adjacent relationship to an underlying floor. Each side support at its upper end region is directly associated by conventional fastening means to the undersurface of the top platform member.

Optionally but preferably, the monitor support structure is additionally provided with a keyboard-supporting tray which is slidably horizontally movable from a storage position under the platform member to an extended position projecting outwardly from the front edge of the platform member.

The present invention can thus achieve a work station structure that comprises in combination the monitor support structure, and a top platform member with a transparent portion. The combination is associatable with a back wall member and preferably includes a slidable keyboard supporting tray. The work station structure is well adapted for use in a modular working area or in an office cubicle having adjacent wall regions that are defined by modular wall panels of the like.

The monitor support structure and an associated flat top platform member provide a safe, effective, and efficient unitary combination.

The monitor support structure is easy to assemble from a kit or the like. If desired, the assembled desk structure can be subsequently easily disassembled, relocated for use elsewhere, and reassembled.

The monitor support structure can be associated with a flat top platform member which provides a maximal working surface area for a worker and which is well suited for use in modular and other types of use environments.

Other and further objects, aims, features, purposes, advantages, modifications, embodiments and the like will be apparent to those skilled in the art from the teachings of the present specification taken with the appended drawings and associated claims.

BRIEF DESCRIPTION OF THE DRAWINGS

In the drawings:

FIG. 1 is a perspective view of one embodiment of a monitor support structure of the present invention which is shown in illustrative combination with a flat top platform member (that includes a keyboard-supporting slidable tray) and a modular wall panel;

FIG. 2 is a front side elevational view of the embodiment shown in FIG. 1;

DETAILED DESCRIPTION

Figure 3:
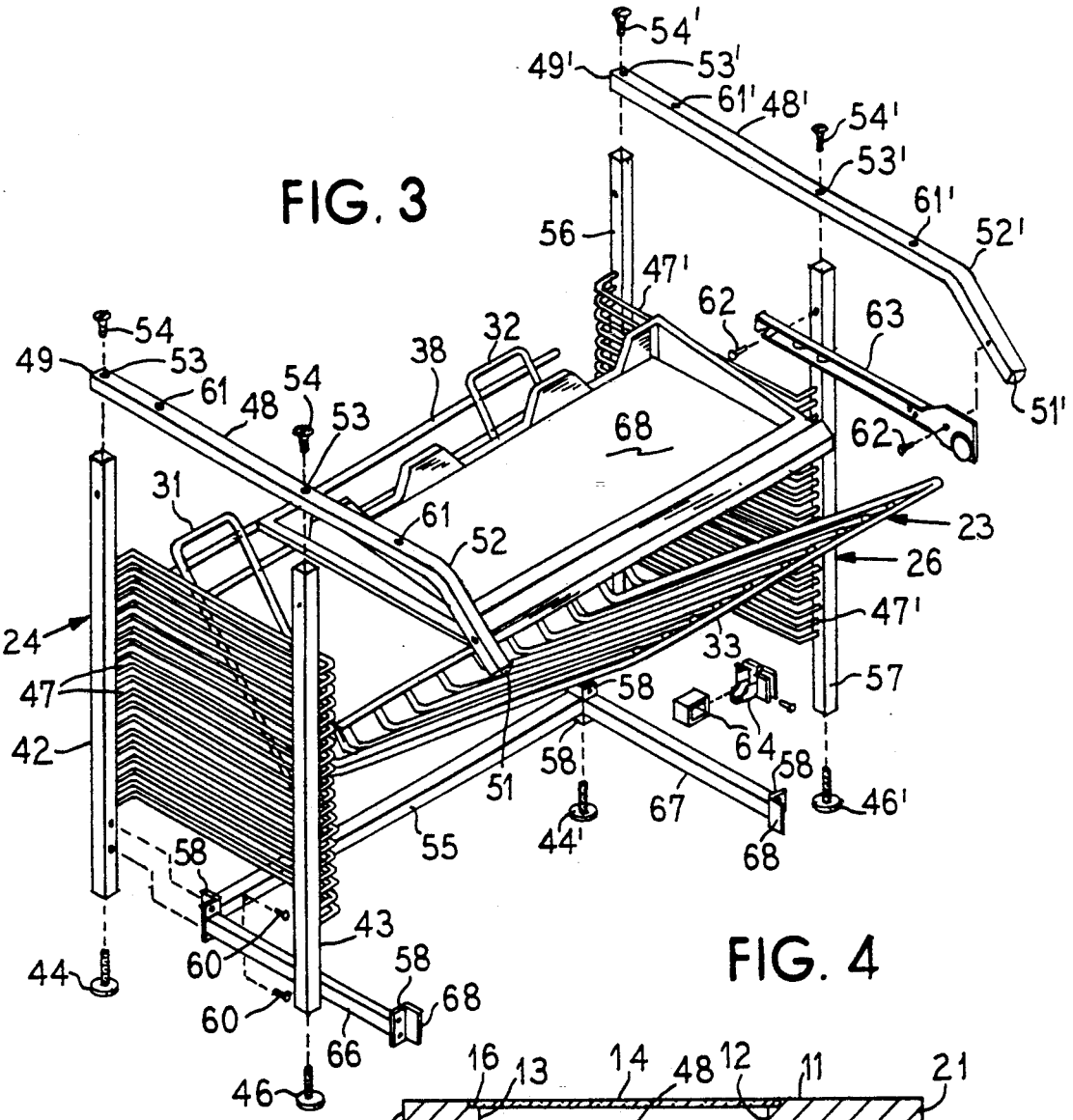
FIG. 3 is an exploded perspective view of the monitor support structure shown in FIG. 1.
Figure 4:
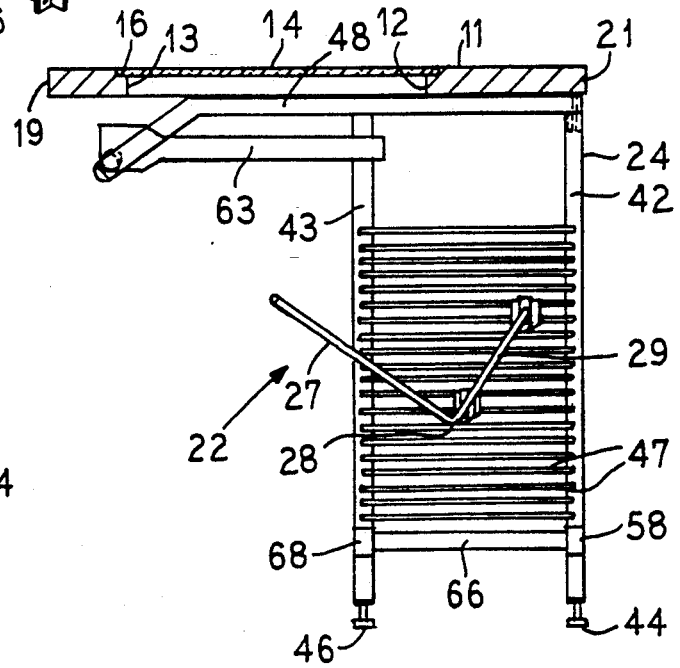
FIG. 4 is a transverse vertical sectional view taken along the line IV—IV of FIG. 2 (with the keyboard-supporting slidable tray separated and not shown)
Figure 5:
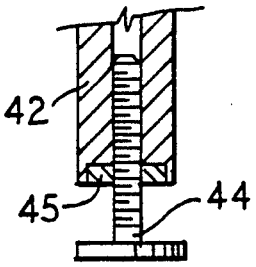
FIG. 5 is a fragmentary vertical sectional view through the bottom region of a leg of a side support of the monitor structure of FIG. 1.

Referring to FIGS. 1 through 4, there is seen an embodiment of a monitor support structure 10 of the present invention. The monitor support structure 10 is shown in supporting association with a top platform member 11 which is preferably rectangular or square configured, and generally horizontally extending.

The top platform member 11 is conveniently formed of a preferably thickened, dimensionally stable material, such as wood or wood based material, filled plastic, honeycomb molded plastic, formed sheet metal, a combination of materials, or the like. Use of wood or wood based or filled materials is presently preferred, such as plywood, particle board, fiber board, and the like, and a top platform member 11 so comprised of such a material is preferably conventionally laminated on its respective opposed outer faces to a layer comprised of a melamine polymer of the like. Exposed edge portions are preferably also similarly covered by such a laminate layer.

Top platform member 11 has an aperture 12 formed therein which preferably has appropriately beveled sides that are adapted to support and hold edge portions of a fitted transparent plate member 14 that is formed of clear glass or clear plastic (such as a polyacrylic resin or the like). Preferably, and as shown (see FIG. 4, for example), the lower portion of the side walls defining the aperture 12 are provided with an inwardly projecting flange 13 so that bottom edge adjacent portions peripherally about the transparent member 14 can rest upon a horizontal flat upper shoulder 16 of flange 13 with the upper portion of the sides of aperture 12 being perpendicular relative to shoulder 16. Aperture 12 is conveniently centrally formed in top platform member 11 relative to the lateral side edges 17 and 18 thereof, and is conveniently nearer to the front edge 19 thereof than to the back edge 21 thereof. Aperture 12 and plate member 14 are preferably generally square or rectangular in perimeter configuration and are preferably substantially larger in surface area than the surface area of the desired monitor screen that is to be supported by monitor support 10 and also viewed through plate member 14. Aperture 12 is located over a kneehole 22.

The monitor support assembly 10 incorporates a shelf member 23 upon which a monitor (not shown) can rest and a pair of side supports 24 and 26 which support the shelf member 23. The shelf member 23 has a flattened bottom support member 27 and, at an adjoining rear shelf edge 28, a flattened back support member 29 that integrally upstands or extends preferably perpendicularly from the edge 28.

The shelf member 23 can have various structures, but it is preferred that the shelf member 27 have an open grill or mesh-like structure so as to enhance heat dissipation from a monitor when in use. Suitable materials of construction for the shelf member 23 include sheet metal with vent holes, perforated sheet metal, expanded sheet metal, combinations of welded sheet metal with wire, wire with interwelded crossover locations, vented reinforced plastic, such as polyester platforms, and the like.

The shelf member 23 is, and as shown, preferably comprised of formed heavy wire members which are welded together at points of contact therebetween. Thus, shelf member 23 incorporates a perimeter defining wire 33 which is folded (bent) upwards at the rear shelf edge 28, and, at each opposed lateral upper back end edge 31 and 32, respectively, is also folded laterally inwardly (in opposed relationship) so as to provide added strength for the back member 29 by using two coplanar lengths of the wire 33 extending along each lateral opposed side edge 34 and 36 of shelf member 23. The interior lengths of wire 33 in back 29 extend from edges 31 and 32 downwardly around edge 28. Back member 29 is further provided in this embodiment with a pair of vertically spaced, parallel, longitudinally extending back member supporting wires 37 and also with a pair of vertically spaced, parallel, longitudinally extending shelf supporting wires 38 and 39.

The opposed respective ends 38A and 38B of wire 38 and ends 39A and 39B of wire 39 each extend somewhat beyond the respective side edges 34 and 36 thereby to provide support stub shafts which extend laterally longitudinally outwardly from the back member 29 in respective opposed relationship to one another. The wire 38 is preferably adjacent to the upper back edges 31 and 32 and the wire 39 is preferably adjacent to the edge 28. Other locations for shelf supporting wires can be used, as those skilled in the art will appreciate, such as locations associated with the bottom support member 27, or with each of the bottom support member 27 and the back support member 29.

The space between the lateral side edges 34 and 36 in the region of the bottom support member 27 is supported by a plurality of laterally spaced, parallel, transversely extending bottom member support wires 41 which in the region of rear edge 28 are bent upwards and welded to at least one of the wires 37, or 39, thereby to aid in providing rigidity and support when the bottom member 27 is cantilevered from the back member 29 as the back member 29 is supported by stub shaft portions of wires 38 and 39.

The respective side supports 24 and 26 each extend vertically the full distance from contacting engagement with the adjacent portions of the underface of the top platform member 11 to a supporting floor surface (not shown).

Each side support 24 and 26 is similar to the other, except that support 26 is turned 180 degrees relative to support 24. The structure of support 24 is representative also of that of support 26. Support 24 includes a pair of transversely spaced (relative to their orientation in the assembled monitor support structure 10) legs 42 and 43 which preferably have a cross-sectionally square tubular configuration and which are preferably comprised of steel or the like. The length of each leg 42 and 43 is equal to the other and this length extends from the floor to the undersurface of the platform 11.

Optionally but preferably, the bottom of each leg 42 and 43 is interiorly fastened preferably by welding to a nut 45 into which the threaded stem of an adjustable foot 44 and 46, respectively, is threadably engaged so as to provide height adjustment and leveling adjustment capability for each leg 44 and 46 (with corresponding feet 44' and 46' being provided for the legs 56 and 57 of the side support 26).

The entire mid-region of side support 42 is provided with a plurality of vertically equally spaced, parallel, horizontally oriented C-shaped heavy wires 47 which are butt welded at each of their respective ends to the mid-region of a corresponding side face of each of legs 42 and 43. After the welding, which produces a ladder-like arrangement for the wires 47 relative to the legs 42 and 43, the wires 47 are preferably dipped or otherwise treated to coat each wire 47 with an electrically insulative, elastomeric polymeric coating, such as a vinyl plastisol or the like. Support 26 is similarly provided with wires 47'.

The shelf member 23 is adjustably connected to, and supported by, the side supports 24 and 26 by any convenient means. However, it is presently much preferred to associate each of the ends 38A, 38B, 39A and 39B with an adjacent pair of the wires 47 and 47' of the side supports 24 and 26, respectively, using a locking block assembly 64, such as is described in the aforereferenced U.S. Pat. No. 5,125,725 and in U.S. Ser. No. 906,837 filed Jun. 30, 1992.

Interiorly and across the top end of each leg 42 and 43, a nut (not shown) is secured by welding or the like. A cross bar 48 which is preferably cross-sectionally square and tubular like the legs 42 and 43 is laid across each of the top ends of the legs 42 and 43. Preferably (and as shown) the rear end 49 of the bar 48 is coincident with the back side of rear leg 42, and the forward end 51 of the bar 48 extends forwardly beyond the front leg 43 to a location which is preferably approximately just short of the anticipated forward edge 19 of the platform 11. At a location 52 that is in transversely rearwardly spaced relation to forward end 51 along the bar 48, the bar 48 is bent downwardly. The angle of this bend at location 52 can vary, but is typically and preferably in the range of about 25 degrees to about 50 degrees with a bend angle of about 30 degrees being presently most preferred. The bar 48 is provided with transverse bores 53 that are aligned with the upper end of each of the legs 42 and 43 so that screws 54 (preferably flat headed and mountable so as to be flush with the upper side of bar 48) can be threadably engaged through the bores 53 with the nuts in the top ends of legs 42 and 43, thereby to mount the bar 48 to each of the legs 42 and 43. Bar 48' of support 26 is similar to bar 48 and corresponding parts and features are similarly numbered, but with the addition of prime marks thereto, for identification purposes.

To join and hold the side supports 24 and 26 in a desired fixed laterally spaced relationship relative to one another, a horizontally oriented brace or cross support 55 is provided. Conveniently and preferably, brace 54 has a cross-sectionally square configuration like that of legs 42 and 43. Brace 55 is positioned in spaced, adjacent relationship to the underlying floor. Brace 55 extends between the back leg 42 of side support 24 and the black leg 56 of side support 26. The brace 55 is preferably C-configured and hence is provided at each of its opposite ends with a perpendicularly transversely extending extension 66 and 67. Extension 66 extends between the legs 42 and 43 of side support 24, and extension 67 extends between the legs 56 and 57 of side support 26. To achieve an abutting relationship between leg sides and adjacent portions of the brace 55 and of its extensions 66 and 67, the opposite ends of each of brace 55, extension 66 and extension 67 are provided with a vertical terminal plate 58 by welding or the like. Adjacent corners of the plates 58 and legs 42 and 56 are welded or otherwise mounted together to provide a continuous structure for the C-configuration of brace 55. Preferably, each plate 58 extends above and below its associated brace 55, and also for extensions 66 and 67, so that, through bores therethrough, each plate 58 is mounted to the adjacent leg 43, 42, 56 and 57 by two screws 60 threadably engaged through mating tapped holes in each such leg. To aid in stabilizing and bracing the plates 58 against legs 43 and 57 on the outer (open) end of each extension 66 and 67, each plate 58 is preferably (and as shown) associated with a retaining side plate 68 by edge welding or the like.

Platform 11 is laid over the bars 48 and 48' of the respective side supports 24 and 26 and is fastened thereto by any convenient means. Conveniently and preferably screws (not shown) are extended vertically through bores 61 and 61' in bars 48 and 48' respectively and are received in threaded engagement with the underside of platform 11.

The downturned forward end 51 and 51' of each crossbar 48 and 48' provides a forward mounting location for the forward end of each respective one of a pair of conventional fixed drawer slides 63. Each drawer slide 63 extends horizontally and transversely backwards from its associated ends 51 and 51' and into lateral abutting engagement with a side of individual legs 43 and 57, respectively. Screws 62 that extend through aligned bores in the slides 63 threadably engage with threaded mating holes in the crossbars 48 and 48' and in the legs 43 and 57 to complete this mounting of slides 63 in laterally spaced, parallel relationship to one another.

Under the top platform member 11 across the top portion of the kneehole 22, there is preferably located a transversely short keyboard holding or supporting platform or tray 68 that is transversely and horizontally slidable form the closed position shown in FIG. 1 to a fully extended position at which a keyboard (not shown) which rests upon the tray 68 is fully exposed and usable by a worker (not shown) seated before front edge 19 of platform member 11. The sliding capability for the tray 68 is achieved by mounting conventional rails (not detailed) on opposing sides of the tray 68 which rails matingly engage with the individual respective adjacent ones of the slides 63 and thereby provide the desired horizontal slidability. for the tray 68. While various structures for the tray 68 can be employed, a presently preferred structure is shown and described in copending U.S. patent application Ser. No. 774,416 filed Oct. 10, 1991 (the relevant disclosure of which is incorporated herein by reference).

To avoid any tendency for the assembly of monitor support structure 10 and platform member 11 to tilt forwards, the platform member 11 and/or the monitor support structure 10 can be fastened to a vertical wall member, such as a back wall member 71 and/or a side wall member 72. The wall members 71 and 72 can be component panel portions of a conventional modular office structure. The fastening means can be conventional (such as brackets, screws, or the like, as desired). The assembly of monitor support structure 10 and platform member 11 is suitable for use as a work station in many different environments, such as in an environment where the central processing unit (or CPU, not shown), with which the monitor supported by the shelf member 23 and also the keyboard supported by the tray 68 are associated by wire and cable means (not shown), is remotely situated relative to the work station, and where a printer (not shown) is similarly remotely situated and associated.

The monitor support structure 10 is also suitable for association with a conventional desk structure, such as a desk structure which is being retrofitted with a top surface portion that includes a transparent window and with a monitor support structure of this invention for supporting a monitor beneath the window. In such an application, the monitor support structure of this invention can be employed either without the bars 48 and 48', or with transversely shortened versions of the bars 48 and 48', whichever is preferred, as when the desk involved is already provided with a slidable tray that is to be used for keyboard support. The monitor support structure 10 is particularly advantageous and well suited for association with a desk structure when structure 10 incorporates the preferred form of the legs 42 and 43 in side support 24 and the legs 56 and 57 in side support 26 wherein each leg is equipped with an adjustable foot 44, 46, 44' and 46' respectively. Such leg height adjustability results in the structure 10 being suitable for use with desk structures having top platforms that vary in above floor height. Leg height adjustment is simply and readily achieved by changing the stem position of an adjustable foot relative to the leg bottom.

Various other embodiments, applications, features, alternative but equivalent structures and the like will be apparent to those skilled in the art from this description of the present invention and no undue limitations are to be drawn therefrom.

What is claimed is:

1. An adjustable monitor support assembly for positioning and supporting a monitor under a transparent portion in a working platform comprising:

(a) a shelf member having a bottom support portion, a back support portion angularly extending from a rear region of said bottom support portion, lateral side edge portions, and a plurality of support members engaged with said lateral side edge portions;

(b) a pair of side supports, each one being substantially vertically oriented, disposed in longitudinally spaced, parallel relationship relative to the other, and located along a different respective one of said side edge portions;

(c) each one of said side supports having (1) a forward leg member and a rearward leg member which together comprise a pair of transversely spaced leg members which extend vertically from a floor surface to said working platform; and (2) a plurality of vertically spaced, transversely extending, load bearing members, each said load bearing member having opposite end portions that include fastening means for mounting each of said opposite end portions to a different one of said leg members of said pair;

(d) cross brace means including joining means for longitudinally joining said rearward leg members together; and (e) adjustable connector means for connecting individual ones of said support members selectively to at least one of said load bearing members of each said side support so that said shelf member is vertically positionable, transversely translatable and tiltably adjustable relative to said side supports.

2. The assembly of claim 1 wherein each one of said side supports additionally includes a generally horizontally oriented top bar member which:

(a) extends transversely; and (a) has holding means for holding each said top bar member to an upper end portion of each one of said leg members of said pair.

3. The assembly of claim 2 wherein said bar members project forwardly beyond said forward leg members out over a kneehole region and each said bar member includes a forward, terminal downturned segment, thereby to provide a pair of laterally spaced forward downturned bar member ends.

4. The assembly of claim 3 wherein each one of said side supports additionally includes a slide member including mounting means for horizontally mounting said slide member between said forward downturned end of said bar means and the transversely adjacent one of said forward leg members.

5. The assembly of claim 4 wherein a keyboard supporting tray with a rail member horizontally mounted on each opposed lateral side is provided, and each one of said rail members is slidably engaged with an adjacent one of said slides so that said tray is slidably extendible from a first position in said kneehole region to a second position that is outwardly extended from said first position.

6. The assembly of claim 5 wherein a top platform is positioned over said adjustable monitor support assembly and is supported by and is connected with each one of said bar members.

7. The assembly of claim 1 wherein said cross brace means includes transversely extending extensions that additionally include further means for joining each said extension with said forward and said rearward leg member of one of said side supports.

8. The assembly of claim 1 wherein each said adjustable connector means comprises a locking block assembly.

9. The assembly of claim wherein a top platform is positioned over said adjustable monitor support assembly, and is supported by and is connected with each one of said side supports.

10. The assembly of claim 1 where each said leg member is connected at its bottom portion with an adjustable foot means.

11. A work station comprising a top platform that includes a transparent portion, and an adjustable monitor support assembly which supports said top platform, said assembly comprising in combination:

(a) a shelf member having a bottom support portion, a back support portion angularly extending from a rear region of said bottom support portion, lateral side edge portions, and a plurality of support members engaged with said lateral side edge portions;

(b) a pair of side supports, each one being vertically oriented, disposed in longitudinally spaced, parallel relationship relative to the other thereof, and located along a different respective one of said side edge portions;

(c) each one of said side supports having (1) a forward leg member and a rearward leg member which together comprise a pair of transversely spaced leg members which extend vertically from a floor surface to said working platform; and (2) a plurality of vertically spaced, transversely extending, elongated load bearing members, each said load bearing member having opposite end portions that include fastening means for mounting each of said opposite end portions to a different one of said leg members of said pair;

(d) cross brace means including means for longitudinally joining said rearward leg members together; and (e) adjustable connector means for connecting individual ones of said support members selectively to at least one of said load bearing members of each said side support so that said shelf member is vertically positionable, transversely translatable and tiltably adjustable relative to said side supports.

12. The work station of claim 11 wherein each said leg member is connected at its bottom portion with an adjustable foot means.

* * * * *

UNITED STATES PATENT AND TRADEMARK OFFICE

CERTIFICATE OF CORRECTION

PATENT NO. : 5,290,099

DATED : March 1, 1994

INVENTOR(S) : John N. Lechman

It is certified that error appears in the above-indentified patent and that said Letters Patent is hereby corrected as shown below:

Col. 1, line 43, change "by" to --be--.

Col. 2, line 35, change "of" to --or--.

Col. 3, line 22, change "of" to --or--.

Col. 5, line 50, change "black" to --back--.

Col. 6, line 29, change "form" to --from--.

Col. 6, line 38, change "slidability." to --slidability--.

Col. 7, Claim 2, line 5, change "(a)" to --(b)--.

Col. 8, Claim 9, line 1, change "claim" to --claim 1--.

Signed and Sealed this

Tenth Day of January, 1995

Bruce Lehman

*Attest:*

BRUCE LEHMAN

*Attesting Officer*

*Commissioner of Patents and Trademarks*